United States Patent [19]

Kuramochi

[11] 3,934,697

[45] Jan. 27, 1976

[54] SHIFT MECHANISM FOR TYPEWRITER APPARATUS

[76] Inventor: Shigeaki Kuramochi, 24-17-5-chome, Koishikawa, Bunkyo, Tokyo, Japan

[22] Filed: June 6, 1974

[21] Appl. No.: 476,847

[52] U.S. Cl. ..... 197/72; 197/73; 197/79

[51] Int. Cl.[2] ..... B41J 11/14

[58] Field of Search ..... 197/71, 72, 73, 74, 75, 197/76, 77, 78, 79, 80, 81

[56] References Cited

UNITED STATES PATENTS

| | | | |
|---|---|---|---|
| 1,071,976 | 9/1913 | Weeden | 197/72 |
| 1,412,637 | 4/1922 | Uhlig | 197/72 |
| 1,417,904 | 5/1922 | Hess et al. | 197/73 X |
| 1,433,935 | 10/1922 | Campbell | 197/79 X |
| 2,178,682 | 11/1939 | Dobson | 197/73 X |
| 2,705,553 | 4/1955 | Thomson | 197/79 X |
| 2,859,852 | 11/1958 | Suif | 197/73 X |
| 3,057,449 | 10/1962 | Thomson | 197/72 X |
| 3,572,488 | 3/1971 | Kuramochi | 197/73 |

*Primary Examiner*—Robert E. Bagwill
*Assistant Examiner*—R. T. Rader
*Attorney, Agent, or Firm*—Pennie & Edmonds

[57] ABSTRACT

A shift mechanism for a typewriter comprises a platen supporting frame which is mounted for movement about a predetermined axis to align the position of the platen with the type case, numeral or symbol to be printed. The mechanism has capability of shifting the platen and is used both for the change-over of the two different types and for selecting one of three different types. A locking device is provided for the typewriter which allows the continuous printing operation with the changed-over type position maintained as it is, while, for the change-over of letters, such as from a lower to an upper case letter for a single printing operation, the changed-over position is released from the locked state. The holding and releasing of the changed-over position of type can be effected by actuating the key for the type change-over operation without requiring any specific manipulation.

3 Claims, 6 Drawing Figures

SHIFT MECHANISM FOR TYPEWRITER APPARATUS

BACKGROUND OF THE INVENTION

The present invention relates in general to a type change-over or shifting apparatus for a typewriter, the shifting apparatus being particularly adapted for selection of a desired type from a number of different type faces arranged on a single type bar in a typewriter.

In previously known type change-over or shifting apparatus for typewriters of the kind considered herein, the change-over from one type such as lower case letters to a different type such as upper case letters is carried out either by moving a platen supporting frame vertically with respect to the type bars or vice versa. Generally, a complicated and expensive mechanism is required to move either the platen supporting frame or the assembly of the type bars in this manner and at the same time maintain their relative horizontal positions. Furthermore, high momentum is required for the operation.

Additionally, in the conventional type change-over or shifting apparatus, the mechanism for carrying out the change-over or shift from one of two different types to the other requires structure in addition to that for shift operations for carrying out selection capability whereby a desired type from three different kinds of type may be selected for printing.

Thus, the apparatus lack capability of performing separate operations with various structural components which are used in both operations.

SUMMARY OF THE INVENTION

The change-over shifting apparatus of the present invention seeks to overcome the disadvantages which exist in the prior art, as noted above. For carrying out the invention the change-over or shifting apparatus includes a platen supporting frame which is mounted for movement about an axis and capable of being positioned in the path of movement of a type bar and the particular form of indicia to be printed. The change-over or shifting apparatus may carry out both the function of change-over of the two different types and of selecting one type of three different types for printing. A locking device allows a continuous printing operation while maintaining the changed-over type position, while, for the change-over of letters, such as from a lower case letter to an upper case letter for a single printing operation, the changed-over position is released from the locked state. The holding and releasing of the changed-over position of type can be effected merely by actuating a key for the type change-over operation without requiring any specific manipulation.

There has thus been outlined rather broadly the more important features of the invention in order that the detailed description thereof that follows may be better understood and in order that the present contribution to the art may be better appreciated. There are, of course, additional features of the invention that will be described hereinafter and which will form the subject of the claims appended hereto. Those skilled in the art will appreciate that the conception upon which this disclosure is based may be readily utilized as a basis for the designing of other structures for carrying out the several purposes of the invention. It is important, therefore, that the claims be regarded as including such equivalent construction as do not depart from the spirit and scope of the invention.

DESCRIPTION OF THE PREFERRED EMBODIMENT

The typewriter which may be characterized as, although by no means limited to, that variety of typewriter generally denominated as a toy typewriter includes generally a manipulation unit 1, a printing unit 2, and a carriage unit 3. These units will be discussed separately below.

Figure 1:
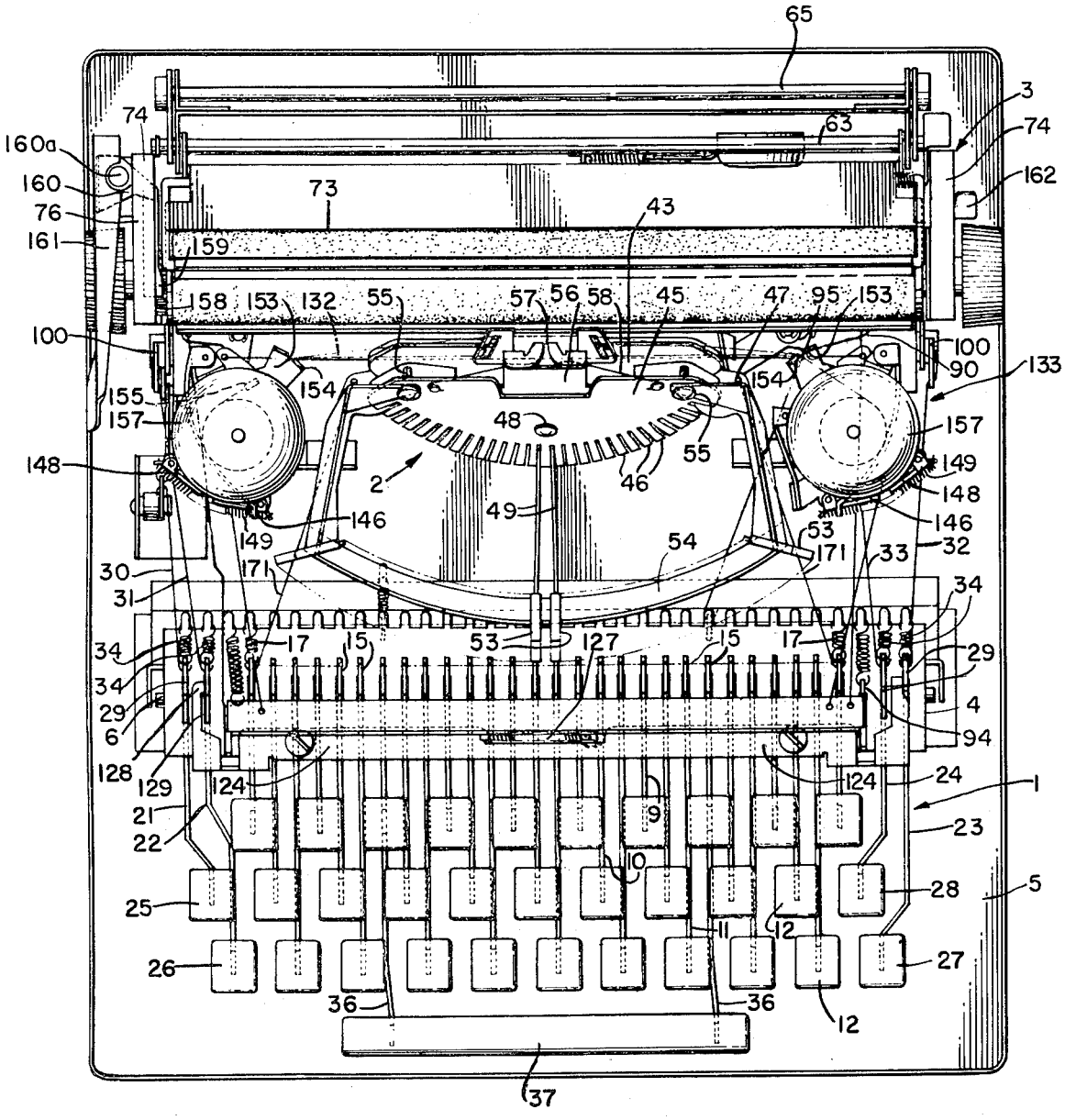
FIG. 1 is a top plan view of the typewriter according to the present invention with the top and side enclosing housing structure removed.

As illustrated in FIG. 1 the manipulation unit 1 generally is disposed within an area toward the front of the typewriter and includes a plurality of finger engageable keys in the form of pad 12, each supported by a key lever including key levers 9, 10 and 11. The key levers are disposed in a plurality of tiers, for example, three tiers (see FIG. 2), with each tier including a plurality of key levers. The carriage unit 3 is generally disposed to the rear of the typewriter and includes a platen 73 and structure for moving the platen between typing limit positions. Finally, the printing unit 2 includes a plurality of type bars 49 which are responsive to the action of any one of the key levers 9, 10 and 11 to cause desired indicia to be transferred to paper supported by the platen 73 as the platen moves in a typing direction between the limit positions. The indicia may be in the form of upper and lower case letters, numerals and symbols of varying kinds. Each type bar 49 may carry a plurality of indicia. Selection of the indicia on the respective type bars is accomplished by means of a type change-over mechanism to be described hereafter in conjunction with other features of the invention.

The manipulation unit 1 is secured to a frame 4 which is supported by a base plate 5 of the enclosing housing.

Figure 2:
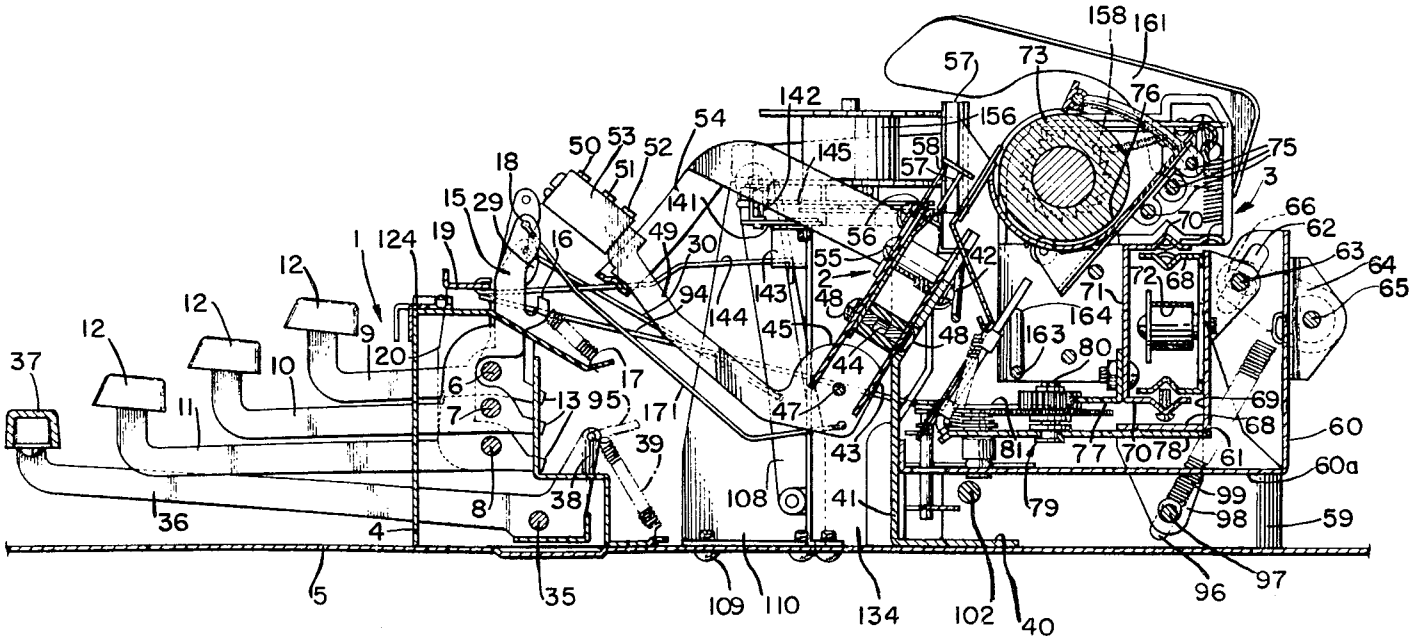
FIG. 2 is a side elevation, in enlarged scale, of the typewriter of FIG. 1 wherein certain portions are broken away and other portions are illustrated in section for purposes of description and understanding.

The frame 4, seen to best advantage in FIG. 2 is configured in the form of an L-shaped enclosure having a front wall, a spaced rear wall including a pair of offset sections and, side walls which are removed inwardly from the side limit of the base plate 5. Each of the front, rear and side walls extend upwardly of the base plate 5. A top wall which completes the enclosure extends generally downwardly to cooperate with the rear wall. A plurality of shafts or rods 6, 7 and 8 are supported by the frame in vertical array. More particularly, the ends of each of the shafts are immovably supported by the side walls.

Each of the key levers 9, 10 and 11 are mounted for pivotal movement about one of the shafts 6, 7 or 8. Thus, the plurality of key levers 9 of a top tier are pivotally mounted on the shaft 6. The plurality of levers 10 of a middle tier are pivotally mounted on the shaft 7. And the plurality of levers 11 of a lower tier are pivotally mounted on the shaft 8. Additional tiers each including a plurality of key levers similarly may be mounted for pivotal movement.

Each of the key levers 9, 10 and 11 generally are similar in form. To this end, the key levers are of bell crank construction having a first projecting arm for supporting the key upon an upwardly bent portion and second actuator arms 15 projecting from a pivot point substantially 90° from the first arms. The first arms are extended somewhat as at 13 to the rear of each shaft. Each of the actuator arms are incremently extended to approximately the same height above the frame 4.

The key levers 9, 10 and 11 are movable within the confines and relative to the frame 4. To this end the frame provides a plurality of slots within the planes of the several key levers. Particularly, a slot in the front wall accommodates the first projecting arm, a slot in the top wall accommodates the actuator arm, and a slot in the upper rear offset section accommodates the extension 13. The length of the rear slot limits or restricts movement of the key lever about a shaft 6, 7 or 8 in response to finger engagement of a key 12.

A projecting ear 16 is formed on each actuator arm of each key lever. The projecting ear is formed within the portion of the actuator arm located outside of the frame 4. A spring member 17 is secured at one end to the projecting ear and at the other end to the downwardly extending portion of the top wall. The spring member 17 serves to bias each key lever in the clockwise or resetting direction of lever movement.

An aperture 18 is formed in each of the actuator arms of the key levers 9, 10 and 11 for purposes to be brought out below.

A bar 19 for actuated advance of the carriage unit 3 and of the ribbon (both to be described) is supported by the frame 4. To this end, the bar in the form of an elongated member to extend across the frame 4 is supported by a pair of spaced vertical legs 20 which extend through a pair of spaced slots in the top wall of the frame 4 and are rotatably mounted on the shaft 8. The bar 19 is disposed adjacent the front edge of the arm of the several key levers. Thus, the bar 19 is caused to pivot about shaft 8 upon each actuation of a key lever of any tier of key levers. The bar is normally biased in the clockwise direction about shaft 8 into engagement with the actuator arms 15.

Structure forming a type change-over or shift mechanism also is supported by the manipulation unit 1. To this end, the shift mechanism includes a plurality of levers 21, 22 and 23. Each key lever is substantially configured for operation as the levers heretofore described, and each is mounted for pivotal movement on the shaft 8. A further lever 24, defining a shift release is also mounted for pivotal movement on shaft 8. The levers 21 and 22 are disposed within the left side region, while the levers 23 and 24 are disposed within the right side region of frame 4 (see FIG. 1). The frame 4 includes a further plurality of slots to accommodate therethrough the projecting, actuating and extending arms of each of the last-named lever 5. One of the slots such as the slot in the upper offset portion of the rear wall may be of a length to determine the extent of pivotal movement of each lever. Each lever is biased in the clockwise or normal direction by a spring 34 acting between an ear on the actuating arm 29 and an extension of the top wall of the frame.

The levers 21, 22 and 23 serve as shift levers. Each of the shift levers and the shift release lever 24 carries a key 25, 26, 27 and 28, respectively, on its projecting arm.

A plurality of rods 30, 31, 32 and 33 are connected at one end to the actuating arm 29 of the levers 21, 22, 23 and 24 and extend toward the rear of the base plate 5 for connection with structure comprising the carriage unit 3. The operation derived through pivotal action of the levers of the shift mechanism will be described below.

Advancement of the carriage unit 3 in the typing direction may be obtained through pivotal movement of a space bar 37 carried at opposite ends by a pair of levers 36. As illustrated to best advantage in FIG. 2, a shaft 35 is supported within the frame 4 near the base plate 5. Each lever 36 also generally of bell crank outline is supported by the shaft for pivotal movement from an inoperative disposition for advance carriage unit 3. Again, the frame is provided with the necessary slots for passing both a forwardly extending arm and an arm 38 projecting substantially at right angles from the location of the shaft 35. As illustrated, the space bar is carried on the forwardly extending arms. A spring 39 is connected to at least one of the arms 38 at one end and at the other end to an ear at the base plate 5 for biasing the levers 36 to the inoperative disposition.

A rod 95 is connected to one of the projecting arms 38 and to the carriage unit advance structure to be described.

The printing unit 2 of the typewriter may be seen to best advantage in FIG. 2. As illustrated, the printing unit is disposed generally within the central portion of the base plate 5 between the manipulation unit 1 and the carriage unit 3. Structure in the form of a mounting plate 41 having a foot portion 40 received on the base plate by any suitable means supports the printing unit for operation. The mounting plate at its upper end is inclined generally toward the carriage unit 3. A further pair of plates 43 and 45 are supported at the incline. The plates 43 and 45 are supported in spaced apart relation by means of a plurality of spacers 44 which may be of cylindrical outline. The plates 43 and 45 may comprise a lower and an upper plate, respectively. The lower plate 43 may be attached to the inclined portion of the mounting plate 41 by one or more screws 42. And the upper plate 45 may be attached to the lower plate by screws 48 received by both plates 43 and 45 and through the cylindrical spacer.

Both the lower plate 43 and the upper plate and 45 define an arcuately shaped lower edge, each including a multiplicity of slots 46 equidistantly spaced across the length of the plates and in alignment between plates.

A rod 47 which follows the arcuate outline is disposed between the upper and lower plates 43 and 45. The rod may be secured between the plates by any means (not shown).

A plurality of type bars 49 equal in number to the number of slots 46 are mounted by the rod 47 for free rotation. The type bars provide at the mounting end a generally circular base portion received through the respective aligned slots and an elongated arm for receipt of a type carrier 53. The type carrier includes typing indicia at the locations 50, 51 and 52. The arms are adapted to receive carriers interchangeably. The indicia may be in the form of upper and lower case letters, numerals, or symbols as are commonly found in typewriters.

Each of the type bars 49 are connected to for actuation by one of the key levers 9, 10 and 11. The connecting means may comprise a rod 171 adapted for receipt at one end within an aperture in an actuating arm 15 of a key lever 9, 10 or 11 at the other end in an aperture in the base portion of a corresponding type bar 49.

A supporting member 54 may be provided for positioning the type bars 49 in a ready - for - printing disposition. The supporting member forms a basket which is secured at the sides to the upper plate 45. Securement may be carried out by means of screws 55.

A guide 56 also is carried by the upper plate 45. The guide includes a pair of members 57 which are inclined toward the rear and toward one another to provide a slot through which the elongated arm of each type bar 49 may pass toward the platen. A bar 58 is disposed at the opening and serves as a stationary brake to reduce the striking action of the type bar 49 in response to actuation of a key lever.

The carriage unit 3 is located to the rear of the base plate 5. The carriage unit serves to support a platen 73 for stepped movement in response to finger engagement with the key of any one of the key levers 9, 10 and 11 and to position the platen by means of the shift mechanism in position to be struck by the indicia at one of the locations 50, 51 or 52.

Figure 3:
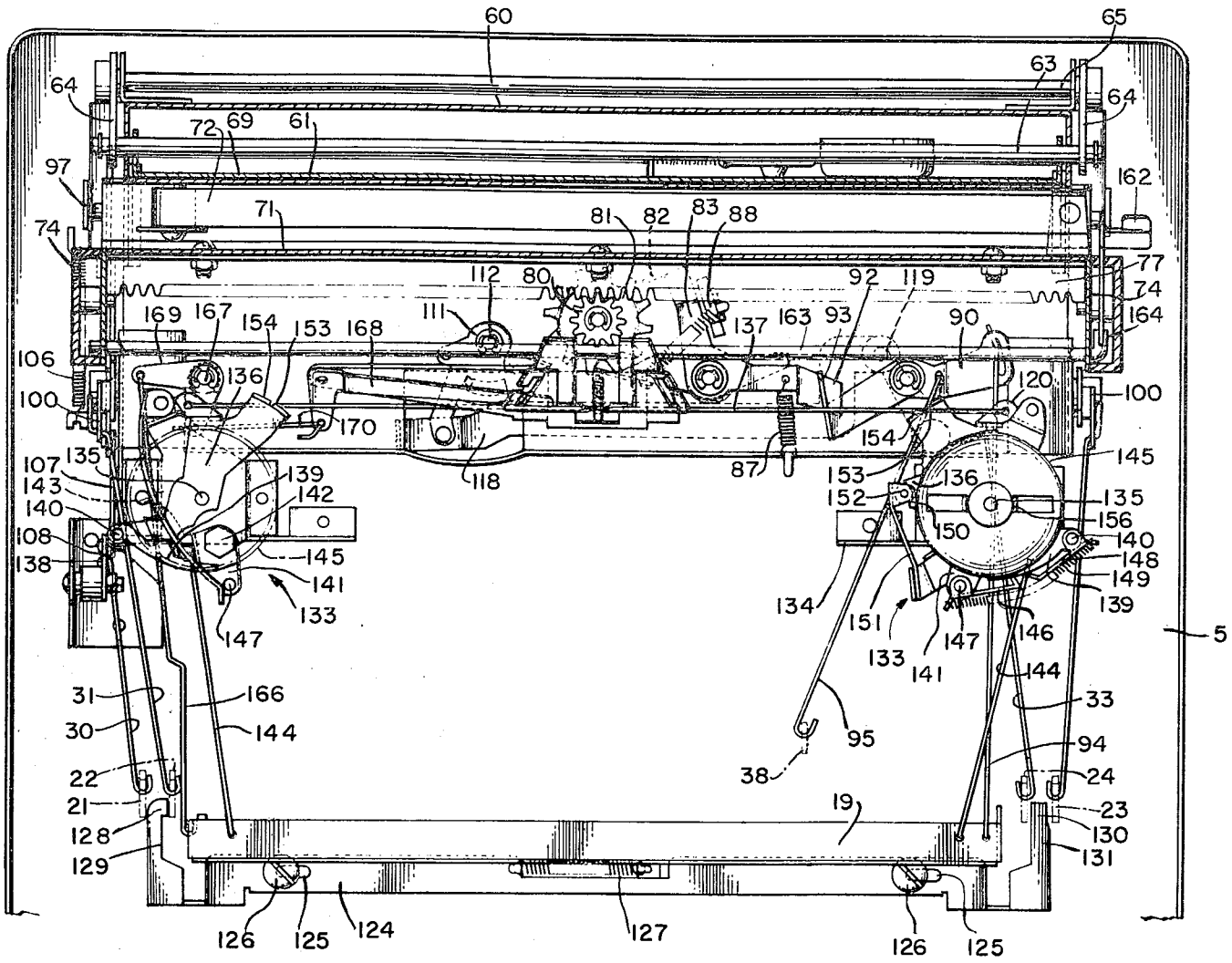
FIG. 3 is a view similar to FIG. 1 illustrating, however, in enlarged scale the type change-over structure of the invention.
Figure 4:
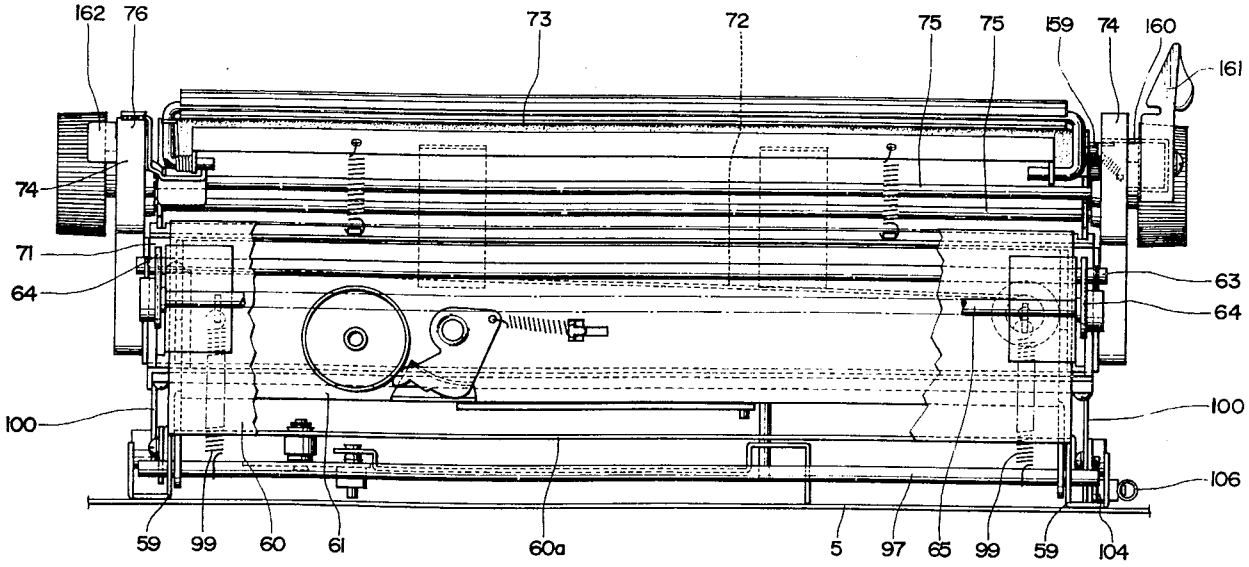
FIG. 4 is a rear elevation of the typewriter illustrated in FIG. 1.

The supporting structure includes a frame 60 including a base 60*a*, a rear portion at substantially a right angle thereto and opposed side walls at substantially right angles to the rear wall. The side walls extend for a short distance toward the front of the typewriter (see FIG. 6) to the region of a lift plate 61. The frame 60 is carried by a pair of spaced legs 59 mounted at one end to the base plate 5. An elongated, inclined slot 62 is formed in each side wall. A supporting shaft 63 is received for movement within the confines of the slots to traverse at least between the side walls. As illustrated in FIGS. 2 and 3, the lift plate is of L-shaped construction and includes a pair of rearwardly directed spaced ears. The ears are apertured for mounting the lift plate for pivotal movement on shaft 63. Preferably the lift plate 61 resides between the side walls of the frame 60.

The rear wall of frame 60 mounts a pair of brackets of L-shaped outline. The brackets are disposed at opposite sides of the rear wall and support an elongated interlocking shaft 65 within an aperture in each. A member 64 is carried at each end of for rotation about the interlocking shaft. The supporting shaft 63 is received through an elongated slot 66 in each of the members 64.

A guide frame 69 including upper and lower spaced guide plates 68 is mounted on the lift plate 61 forwardly of the supporting shaft 63. The guide frame 69 is fixed against horizontal movement. A second guide frame 71 similarly formed by a pair of spaced guide plates 70 is cooperatively mounted for movement relative to the former. Movement is enhanced by means of a bearing race disposed between the facing concave portions in the respective guide plates. Movement of the carriage unit 3 in the typing direction is controlled by an escapement mechanism 79 activated by the key levers 9, 10 and 11 as well as the levers 36 of space bar 37. A constant load spring 72 is secured between the stationary and movable guide frames 69 and 71, respectively, and biases the carriage to the left as viewed in FIG. 1.

A frame 76 including a pair of plates 74 are carried at opposite ends of the movable guide frame 71. The plates 74 are connected together by a pair of connecting rods 75. The platen 73 is mounted for free rotation by the frame 76.

The escapement mechanism 79 includes a rack 77 carried by the movable guide frame 71. The escapement mechanism is disposed on a mounting plate 78. The mounting plate extends from and is secured to the lift plate 61. A gear 80 is keyed or otherwise secured to a shaft journelled for movement in the mounting plate. The gear is disposed for meshing cooperation with the teeth of rack 77.

Figure 5:
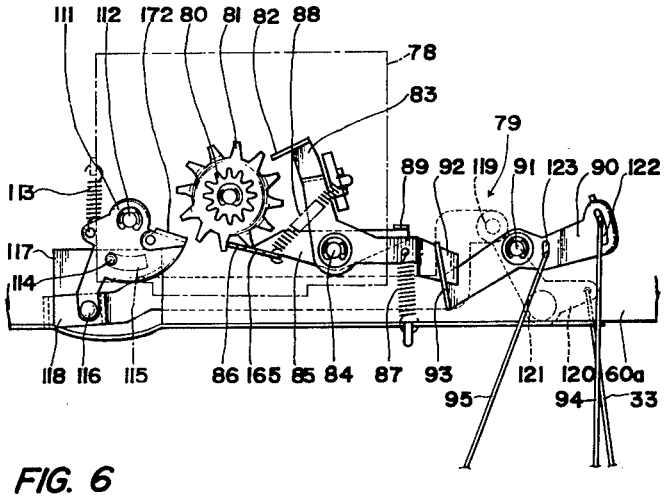
FIG. 5 is a view similar to FIG. 1 illustrating in enlarged scale the carriage feeding mechanism of the typewriter; and, FIG. 6 is a side elevation of the type change-over structure of FIG. 3.

A ratchet wheel 81 (see FIG. 5) is similarly mounted to the shaft. A pawl or feed lever 83 generally of bell crank outline and a holding lever 85 having a pair of oppositely extending arms are disposed adjacent to for cooperation with the ratchet wheel 81 for moving the carriage. The feed and holding levers 83 and 85 are carried by a pin 84 depending from the mounting plate 78. Both the feed and holding levers are freely pivotable about the pin 84. The feed lever 83 includes an extension 82; whereas the holding lever 85 includes an extension 86. The extensions are movable into position of engagement and disengagement with the teeth of ratchet wheel 81 during operation. The feed lever is normally biased about pin 84 to the disengaged position. To this end a spring 87 is secured between the feed lever 83 and the mounting plate 78. At this time the holding lever is biased about pin 84 into the engaged position as illustrated in FIG. 5. To this end, a further spring 88 is secured between the holding lever 85 and the mounting plate 78.

An extension 89 is formed on the holding lever 85. The extension is disposed in the path of movement of the feed lever 83 toward the engaged position. Thus, upon movement of the feed lever 83 for intercooperation of the extension 82 and the ratchet wheel 81, the holding lever 85 moves similarly in a counterclockwise direction and the extension 86 disengages from the teeth of ratchet wheel 81.

An actuation lever 90 controls movement of the feed lever 83 and extension 82 into engaging position with the ratchet wheel 81. The actuation lever 90 is formed by opposed arms and is mounted for pivotal movement on a pin 91 carried by the base 60*a* of frame 60. The lever 90 includes a portion 93 formed at the end of one arm. A pair of spaced slots 122 and 123 are provided in the other arm of the lever. By means of the slots the lever 90 is connected both to the bar 19 and to the space bar 37. To this end, a rod 94 is connected between the slot 122 and the bar 19. A rod 95 is connected between the slot 123 and one of the levers 36 of the space bar 37. Upon each actuation of either a key 12 or space lever 36 of spacer bar 37 the portion 93 engages with the end 92 of feed lever 83 to cause the lever to pivot counterclockwise against the bias of spring 87. Full movement causes engagement of extension 82 with and disengagement of extension 86 from the teeth of ratchet wheel 81. Upon release of the extension 82 to the disengaged position the carriage unit 3 steps by one step to the left under the bias of spring 72. Disengagement of the extension 82 follows as the various levers return to the normal position under the control, for example, of springs 17 and 39. The feed lever 83 is biased toward disengagement by spring 87 which functions, also, to bias the bar 19 into engagement with the actuator arms 15 of the levers 9, 10 and 11.

An actuator shaft 97 which traverses the carriage unit 3 is carried by the spaced legs 59 of frame 60. To this end, the spaced legs are provided with elongated slots 96 within which the actuator shaft is free to move. The shaft 97 may be restrained axially between the spaced legs 59 in any convenient manner.

The actuator shaft near the ends supports a pair of extensions 98 which depend downwardly from the mounting plate 78. As may be appreciated each pair of slots 62 and 96 are inclined at substantially the same angle thereby to be parallel each to the other. The actuator shaft 97 is tensioned toward the upper end of slots 96. To this end, a spring 99 is secured between the actuator shaft 97 and a fixed ear on the frame 60 near the rod 65.

Figure 6:
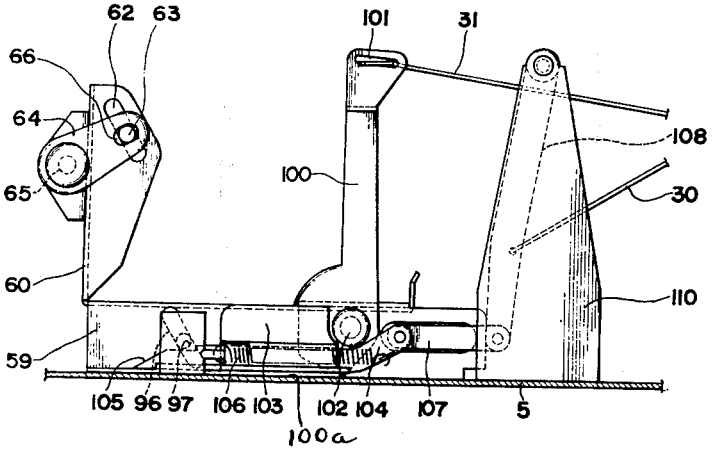

Referring to FIGS. 1 and 6 in particular, a pair of levers 100 are keyed or otherwise mounted to a shaft 102 at opposite sides of the carriage unit 3. Each lever includes a slot 101 in the region removed from the pivot connection for receipt of one end of the rods 31 and 32. The rod 31 is connected at the other end to the actuation arm of lever 22 while the rod 32 at the other end is connected to the actuation arm of lever 23. The shaft 102 is secured against axial movement relative to levers 100.

A frame member 103 is secured at the region of the pivot connection of one of the levers 100. As illustrated the frame member 103 is secured to the left hand (FIG. 1) lever 100.

The frame member 103 is movable with the lever 100 and includes a pair of substantially juxtaposed plates, the rearward of the plates being coplanar with the lever 100 and including a forwardly directed foot 100a, while the forward of the plates includes an offset portion adjacent the foot to provide a slot between the plates. A lift actuator 104 is movable backward and forward within the slot above the foot 100*a*. The lift actuator is formed with a slant guide surface edge 105 at the end toward the carriage unit 3. A spring 106 is disposed between the frame member 103 and the lift actuator 104 for purposes of biasing the latter toward the carriage unit 3 and into engagement with the lower surface of shaft 102.

A further lever 108 is connected to the lift actuator 104. A connecting element 107 may be pivotally connected to the lever 108 at one end and to the lift actuator 104 at the other end. The lever 108 depends from and freely pivots about a stud carried by the frame 110 supported on base plate 5. A plurality of screws 109 may be employed for mounting securement.

The rod 30 acting as a changeover interlocking rod is connected at one end to the actuation arm of lever 21 and at the other end to the lever 108. Connection may be at a position between the two lever pivot points. A reset or return lever 111 (see FIG. 5) is mounted freely on pin 112 carried by mounting plate 78. The reset lever includes a claw element 172. The claw element is mounted on the reset lever for engagement with the ratchet wheel 81. The reset lever normally is biased to a position at which the claw element is out of engagement. A spring 113 is connected between the reset lever and the mounting plate for purposes of clockwise bias of the lever. A pin 114 is carried and projects upwardly from the reset lever. The pin engages in a slot 115 in the mounting plate which defines the unit of rotation of the reset lever about the pin 112.

The reset lever 111 provides an extending finger portion. A rod 116 is pivotally connected to the reset lever at the finger portion. The rod extends through an opening 117 in the base 60*a* of frame 60. The other end of the rod 116 is linked to a reset actuator 118 located below the base 60*a*. The reset actuator is defined by an elongated arm terminating in a crank portion. A lever 120 likewise of bell crank construction is mounted by the base 60*a* adjacent to the crank portion of the reset actuator. The lever 120 is rotationally supported on the base 60*a* by a pin 121 and coupled by one arm to the crank portion of the reset actuator 118 by means of a pin 119. The rod 33 also acting as a change-over interlocking rod is connected to the other arm of lever 120. The change-over interlocking rod 33 in turn is connected to and controlled in movement by the actuating arm of lever 24, the shift release lever.

Referring now to FIG. 3, a type change-over locking plate 124 is illustrated as mounted on the upper surface of the frame 4. The type change-over locking plate is adapted for sliding movement either to the right or to the left as viewed in FIG. 3. The type change-over locking plate 124 is formed with a pair of elongated guide slots 125 located generally at the ends. A guide screw 126 received by the frame 4 projects through the respective slots to engage the type change-over locking plate on the frame. A spring secured between the type change-over locking plate 124 and the frame 4 biases the type change-over locking plate toward the right. A locking latch portion 128 is carried by the type change-over locking plate 124 at one end thereof. The locking latch portion 128 projects rearwardly and defines a lock recess 129 along the right edge. The locking latch portion 128 is engaged by the actuator arm 29 of the type change-over lever 22. Rotation of the type change-over lever 22 results in release from a latch condition. To this end, the actuating arm 29 disengages from the locking latch portion 128 to a position at which the actuating arm is adjacent to the lock recess 129. This results in the type change-over locking plate 124 under spring bias moving to the right. The actuating arm 29 of the type change-over lever 22 then engages with the lock recess 129, whereby the type change-over lever 22 is held in the type changed-over state. Additionally, a release piece 130 is disposed at the other end (right hand end as viewed in FIG. 3) of the type change-over locking plate 124. The release piece projects rearwardly. The rearward projection is formed with a slant release projection 131. The release piece 130 is arranged for intercooperation with the actuating arm 29 of type change-over lever 23 provided at the other side of the typewriter. Upon rotation of the type change-over lever 23, the actuating arm 29 pivots to engage slant release the projection 131 of the type change-over locking plate 124, whereby the type change-over locking plate 124 is moved against the force of the spring 127 in the leftward direction. The actuating arm 29 of the type change-over lever 22 at the other side of the typewriter thereby disengages from the lock recess 129 formed in the locking latch portion 128. As a result, the type change-over lever 22 which theretofore had been in the locked state resets to the released position under the influence of spring 34.

The ribbon feed mechanism 133 for drive of a carbon ribbon 132 is controlled by actuation of key levers 9, 10 and 11 as well as the space bar 37 as will now be described. The ribbon feed mechanism is disposed immediately to the front of and at opposed ends of the carriage unit 3 for positioning the ribbon in the path of movement of the several type bar 49 thereby to transfer indicia to a paper on the platen 73. Preferably, the ribbon feed mechanism is supported above the base plate 5, by means of a pair of frame components 134. The frame components 134 is in the form of a pedestal thereby to dispose the ribbon in the position described. A shaft 135 is journelled for movement in each pedestal. A cam 136 is supported for rotation on each shaft. Each cam includes a projecting edge 138 and the two cams are connected together for conjoint movement, as will be discussed. The connecting means includes a rod 137 coupled to an extending ear on each cam.

An actuator 139 is disposed adjacent to each cam. The actuator 139 is mounted by a stud 140 carried by each frame component 139 for intercooperative engagement with the projecting edge 138 of the respective cams. A feeding actuator 141 is supported for free movement on a second stud 142, also carried by each frame component 134. Each feeding actuator is formed to provide a projection 143. One end of a rod 144 is connected to each projection while the other ends of the rods are connected to the bar 19 at opposite ends (see FIG. 3).

A gear 145 is mounted on each of the shafts 135. A feeding claw member 146 is mounted for pivotal movement into and out of engagement with the respective gears. To this end, the feeding claw member 146 is mounted to the feeding actuator 141. Mounting is carried out by means of a pin 147. A holding claw 148 also engages the respective gears 145. The latter claws 148 are supported by the stud 140 serving as a mount for each actuator 139. A spring 149 engaged between an extending ear on each of the feeding and holding claws 146 and 148 biases the claws into engagement with gear 145.

One of the cams 136, for example, the right-side cam (FIG. 3) includes a position limit projection 150. A resilient piece or leaf spring 151 immovably carried by the frame component 134 of the mechanism supports a roll 152 at the free end. The roll bears against the projection. Each cam, further, is formed with an extension 154 having an upwardly directed wall having a vertical slot 153 throughout a portion of its length. The slot provides a guide surface for the carbon ribbon 132. The slot is of a width such that the elements 155 secured at the opposite ends of the ribbon 132 are prevented from passage.

A bobbin 157 is mounted on each of the shafts 135 for movement in stepped advance with the stepped advance of gear 145. To this end, the respective bobbins engage with a projection 156 carried by the associated gear 145. In a similar manner both the bobbin and the gear may be keyed or otherwise secured to the shaft to obtain the same movement.

A feeding ratchet 158 (see FIG. 2) is mounted at one side and coaxially of the platen 73. A pawl 159 is mounted for engagement with the feeding ratchet. To this end, the pawl may be mounted on a member 160. The member is supported by the frame 76 for pivotal movement about pin 160*a* to draw the pawl into engagement with a tooth on the feeding ratchet. A control member 161 is mounted to the member 160 and pivotal, also, about pin 160*a*. The control member is adapted for movement between a lowered inoperative position and a raised operative position. In the operative position the control member 161 may be pivoted about pin 160*a* with resultant pivotal movement of the member 160 and longitudinal movement of pawl 159. Consequently the feeding ratchet is rotated by stepped advance as is well-known. Thus, the platen is moved for purposes of feeding the paper.

A push rod 163 including opposed crank arm portions 164 at the ends is supported by the frame 76. A return lever 162 likewise mounted by the frame 76 controls rotational movement of the push rod 163. Therefore, the push rod rotates in response to a swinging movement of the return lever 162. This results, further, in pivotal movement of the holding lever 85 in the counterclockwise direction in opposition to spring 88. To this end, the extension 86 of holding lever 85 provides a projection 165 (see FIG. 5) which engages with push rod 163 substantially within an intermediate zone. The movement of the holding lever 85 follows rotational movement of the push rod 163 for disengagement of the extension 86 from the ratchet wheel 81. This action permits hand movement of the frame 76 and carriage unit 3 in the direction toward the right in FIG. 1.

A rod 166 is loosely connected to a lever 169 (see FIG. 3) at one end and to the bar 19 at the other end. The lever 169 is mounted on the frame 60 by means of a shaft or pin 167. The pin provides a free rotatable mount. The lever 169 is linked to a holding frame 168 by way of a connecting rod 170. The holding frame 168 likewise is mounted for free rotation on the frame 60 and serves to hold the ribbon 132 at an intermediate portion. Upon rotation of the holding frame 168, the carbon ribbon 132 may be displaced upwardly or downwardly to be positioned between the type carrier 53 and the platen 73 for printing.

The operation of the typewriter apparatus as described above is as follows:

Selective actuation force on a key 12 of a key levers 9, 10 or 11, for example one of the levers 9, results in counterclockwise pivotal movement of that key lever about shaft 6 in opposition to the force exerted by the spring member 17. The rod 171 connected to the actuator arm 15 of key lever 9 is drawn forward and type bar 49 is rotated clockwise around the rod 47. Upon this operation the imprint of a lower case letter, for example, positioned in the middle location 51 of the type carrier 53 is transferred to a paper sheet on the platen 73 by way of the carbon ribbon 132. Thereafter, when the actuating force is relieved the key lever 9 resets to the normal disposition under the bias influence of the spring member 17. Substantially simultaneously with the printing operation the carriage advance escapement mechanism is rendered operative. To this end, actuation of the key lever 9 causes counterclockwise movement of the bar 19 around the shaft 8. This movement results in a clockwise rotation of the actuator lever 90 (as viewed in FIG. 5) about the pin 91. Clockwise movement is imparted by rod 94 connected between actuator lever 90 and bar 19 whereby portion 93 of the actuator lever 90 in engagement with end 92 of the feed lever 83 moves the latter in the counterclockwise rotational direction against the force of the spring 87. Extension 82 thus engages with the ratchet wheel 81 to prevent the ratchet wheel from being rotated. The movable guide frame 71 for the platen 73 under the bias control of spring 72 is stopped and held in place. The rotation of the feed lever 83 to the engaged position causes the extention 89 of the holding lever 85 to cooperatively follow this movement in the counterclockwise direction against the bias of spring 88, whereby the extension 86 is disengaged from the ratchet wheel 81. When the print transfer has been completed and key lever 9 is reset, the feed lever 83 as well as the holding lever 85 return to their respective inactive positions of FIG. 5 under the bias control of springs 87 and 88. Actuator lever 90 is also reset. And the ratchet wheel 81 is released from the meshing state with the extension 82 on feed lever 83. Gear 80 and ratchet wheel 81 are mounted for conjoint movement. Thus the carriage unit 3 under the bias of spring 72 is stepped by one step for each ratchet movement. Particularly, the movable guide frame 71 is moved through the intermeshing of rack 77 and gear 80. This operation continues through each subsequent actuation whereupon the extension 86 of the holding lever 85 meshes with the next and each succeeding tooth of the ratchet wheel 81. The movable guide frame 71 and hence the platen 73 are displaced by a distance corresponding to the width of a printed letter to the position ready for next printing or spacing actuation.

The feeding actuator 141 for the ribbon drive are controlled by bar 19 through the rods 144 connected between the feeding actuator 141 and the bar 19. The feeding actuator 141 are mounted for rotation on studs 142 provided at both sides of the typewriter. Depending on which of the projecting edges 138 of the cams 136 provided at the left hand and right hand sides engage the respective actuator 139, one of the gears 145 is rotated by means of the associated feeding claw member 146. Movement of the gear results in the rotation of the corresponding one of the bobbins 157 to wind the ribbon 132 thereon.

The type key 26 is activated downwardly to change-over the type from, for example, lower to upper case letters. This activation results in movement of rod 31 in response to pivotal movement of lever 22. One of the change-over actuator levers 100 is then rotated about shaft 102, giving rise to the rotation of the lift actuator 104 of the rotatable frame member 103. The actuator shaft 97 responds with movement within the slot 96 while the lift plate 61 is rotated clockwise around supporting shaft 63, as viewed in FIG. 2. Thus, the platen 73 is moved upwardly to the position where the indicia at the location 50 of the type carrier 53 may be printed through movement of a type bar 49 in response to movement of a particular one of key levers 9, 10 and 11.

When the type change-over lever 22 is rotated as above described, the actuating arm 29 thereof is released from the locking latch position 128 to assume a position within the lock recess 129. Thus, the type change-over locking plate 124 is able to move under the bias control of spring 127. The actuating arm 29 of the change-over lever 22 thereafter engages with the lock recess 129 and the carriage unit 3 and platen 73 is held in the position described. Thus, a type location bar 49 upon actuation in response to movement of one of the key levers 9, 10 and 11 operates to transfer the type 50 by means of the ribbon 132.

When, in this state, the other type change-over lever 23 is operated by the corresponding key 27 its actuation arm 29 engages the slant release projection 131 of the release piece 130 formed in the type change-over locking plate 124. The effect is to move the locking plate 124 against the bias of spring 127, whereby the actuation arm 29 of type change-over lever 22 is released from the engagement with the type change-over locking recess 129 of the lock plate 124. As a result, the type change-over lever 22 is returned to the normal position by the spring 34. At the same time, the change-over actuator levers 100 are also reset and the actuator shaft 97 is relieved of a pushing force exerted by lift actuator 104. Thus, the platen 73 is lowered to the position where the type at location 51 of the type carrier 53 can be printed.

Actuation of type change-over lever 23, by means of the key 27 causes the change-over interlocking rod 32 to be drawn forwardly to pivot the other of the type change-over actuator levers 100. Both the lever and shaft 102 rotate and, again, the actuator shaft 97 is lifted by the lift actuator 104 through the rotatable frame member 103. Concurrently, the lever 100 rotates. The platen 73 is thus lifted to the position where the indicia of type at location 50 of the type carrier 53 is transferred. When the key 27 is released, the type change-over actuator levers 100 and the lever 22 are reset. And the platen 73 is returned to the rest or normal position for transferring the indicia of type at locations 51 to the paper.

If the key 25 is depressed, the lever 108 is caused to pivot by the rod 30 linked to the type change-over lever 21. The lift actuator 104 is drawn against the bias of the spring 106. This is accomplished by connecting element 107. To this end, the lift actuator escapes from the position below the actuator shaft 97 whereupon the actuator shaft 97 moves downwardly in slot 96 thereby to lower the lift plate 61. In consequence, the indicia of the type at location 52 of the type carrier 53 is in position to move toward the platen 73. When key 25 is released, the type change-over lever 21 resets by the spring 34. At the same time the lift actuator 104 also resets because of the force of the spring 106. The lift actuator thereafter is positioned once again below the actuator shaft 97. The actuator shaft 97 moves upwardly in slot 96 through the action of the slant guide surface edge 105. Thus, the carriage unit 3 and platen 73 is returned to the position where the printing of the indicia of the type at location 51 of the type carrier 53 may be carried out. Upon depression of reset or backspace key 28 the reset actuator 118 will be moved toward the right (see FIG. 5). Action is by means of pivotal movement of lever 120 in response to a drawing action of rod 33 and consequent movement of the crank end of the rod about the pin 119. The reset lever 11' is then rotated against the spring 113 whereupon the claw element 172 engages the ratchet wheel 81. The ratchet wheel is caused to rotate in the opposite direction in the state engaged by the feed lever 85. Because of the fact that the ratchet wheel 81 intercooperates with the gear 80 in engagement with rack 77, the movable guide frame 71 is displaced in the return direction and the carriage unit 3 and platen 73 is moved back for a distance corresponding to one type space. Space bar 37, through rod 95 and levers 36 operates the actuator lever 90 to allow the carriage unit 3 and platen 73 to be displaced by a distance corresponding to one type space in the typing direction.

Upon pushing the return lever 162, the push rod 163 is rotated to push the projection 165 of the holding lever 85, whereby the extension 86 of the holding lever 85 is released from the engagement with the ratchet wheel 81. Then, the movable guide frame 71 having the frame 76 can be moved to the starting position against the force of spring 72.

The carbon ribbon 132 is wound on one of the bobbins and movable to the other bobbin 157 in stepped fashion upon every printing operation. The element 155 secured to the ribbon 132 reaches the position of the groove 153 after full advance of the ribbon 132. The element 155 is of a size so that it will not pass the groove. Thus, under the influence of tension exerted by the ribbon 132 on the projecting edge 138 of the cam 136 the cam will release the actuator 139 from the pressing condition and the feeding claw 146 together with the holding claw 148 interconnected by the spring 149 will mesh with the feeding gear wheel 145. Rotation of one cam 136 results in the rotation of the other cam 136, the projecting edge 138 of the latter moving the actuator member 139 outwardly to release the claws 146 and 148 from the meshing positions with the feeding gear wheel 145. The ribbon 132 can thus be wound in the opposite direction throughout the following printing operations. In this manner, the ribbon 132 is alternatively wound by both bobbins 157 because of the elements 155 operating first on one structure and then on the other opposed ribbon feeding structure.

As will be appreciated from the foregoing description, according to the present invention, the movable guide frame 71 having a frame 76 for rotationally mounting the platen 73 is mounted on a lift plate 61 which is moved upwardly or downwardly by means of a lift actuator element 104 mounted reciprocatably on a rotable frame member and spring-biased in the operative direction. Due to this arrangement, the change-over of two or three different types can be effected by one and the same lift actuator element 104. Furthermore, the novel arrangement according to the invention as above mentioned may function as a change-over mechanism and allows the changed-over positions to be releasably locked, for which mere control of the type change-over levers is sufficient, whereby the manipulation of the machine is simplified. Because the type change-over operation is effected by rotational movements, the operation can be carried out very smoothly.

Having described the invention with particular reference to the preferred form thereof, it will be obvious to those skilled in the art to which the invention pertains after understanding the invention, that various changes and modifications may be made therein without departing from the spirit and scope of the invention as defined by the claims appended hereto.

I claim:

1. Printing type change-over apparatus for a typewriter comprising a printing type change-over lever supporting a key, means mounting said type lever for pivotal movement from a first to a second position upon finger engagement of said key, a change-over actuator lever, means mounting said actuator lever for pivotal movement also from a first to a second position, a rod interconnecting said type lever and actuator lever for conjoint movement of said levers from the first to the second position, a frame member mounted on said actuator lever, a lift actuator, said lift actuator being mounted by said frame member, means urging said lift actuator to a first operative position, a lift plate adapted to be moved in a first direction by said lift actuator, a movable guide frame, means mounting said guide frame on said lift plate for movement with said lift plate and relative thereto, a platen, a platen supporting frame mounted on said guide frame, a plurality of type bars in juxtaposition to one another and each having a type carrier on which different types are disposed in a vertical row, means pivotally mounting said type bars for movement toward and away from said platen, and means operatively connecting said lift plate and lift actuator so that said lift plate moves in the first direction when said type lever moves from the first to second position to locate said platen thereby to be struck by one of said different types.

2. Printing type change-over apparatus for a typewriter, comprising a pair of type change-over levers, a pair of change-over actuator levers, an elongated shaft pivotally supporting said actuator levers at spaced locations therealong, a rod connecting each actuator lever to a corresponding one of said type levers, means mounting said type levers for pivotal movement, pivotal movement of any one type lever being followed conjointly by movement of said actuator levers, a frame member, said frame member being mountned on one of said actuator levers, a type change-over locking plate formed with a locking recess for holding one of said type levers in a change-over actuating state and further formed with a release projection engageable with the other of said type levers to release said one type lever from the change-over actuating state, a lift actuator, said lift actuator being mounted by said frame member, means urging said lift actuator to a first operative position, a lift plate adapted to be moved in a first direction by said lift actuator, means mounting said guide frame on said lift plate for movement with said lift plate and relative thereto, a platen, a platen supporting frame mounted on said guide frame, a plurality of type bars in juxtaposition to one another and each having a type carrier on which different types are disposed in vertical row, means pivotally mounting said type bars for movement toward and away from said platen, and means operatively connecting said lift plate and lift actuator so that said lift plate moves in the first direction when one of said type levers is pivoted to locate said platen to be struck by one of said different types.

3. Printing type change-over apparatus for a typewriter, comprising a first type change-over lever supporting a key, a second type change-over lever supporting a second key, a lift actuator, a change-over actuator lever, a second change-over actuator lever, means mounting each of said levers for pivotal movement from a first to a second position and means connecting said first and second levers for conjoint movement, means mounting said lift actuator on one of said actuator levers for pivotal movement therewith and for reciprocating movement relative thereto, means urging said lift actuator to a first operative position, means connecting said lift actuator to the other of said actuator levers for movement of said lift actuator against said urging means to a second operative position when said other actuator lever pivots to said second position, a lift plate, a movable guide frame, means for mounting said guide frame on said lift plate for movement with said lift plate and relative thereto, a platen, a platen supporting frame mounted on said guide frame, a plurality of type bars in juxtaposition to one another and each having a type carrier on which different types are disposed in a vertical row, means pivotally mounting said type bars for movement toward and away from said platen, and means operatively connecting said lift plate and lift actuator so that said lift plate moves in a first direction when said one actuator lever is pivoted to the second position and in a second direction when said other actuator lever is pivoted to the second position to locate said platen to be struck by different ones of said different types.

* * * * *